US006477882B2

(12) United States Patent
Nagao et al.

(10) Patent No.: US 6,477,882 B2
(45) Date of Patent: Nov. 12, 2002

(54) FORMING MACHINE

(75) Inventors: Yuichi Nagao, Omiya (JP); Yoshihisa Doi, Utsunomiya (JP); Takeshi Tatsumi, Tochigi-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/777,711

(22) Filed: Feb. 7, 2001

(65) Prior Publication Data

US 2001/0011469 A1 Aug. 9, 2001

(30) Foreign Application Priority Data

Feb. 7, 2000 (JP) ..... 2000-029572
Feb. 10, 2000 (JP) ..... 2000-033236

(51) Int. Cl.[7] ..... B21J 13/02
(52) U.S. Cl. ..... 72/353.4
(58) Field of Search ..... 72/343, 353.2, 72/353.4, 354.8

(56) References Cited

U.S. PATENT DOCUMENTS 1,651,231 A * 11/1927 Shrum ..... 72/353.4
2,158,312 A * 5/1939 Terrell ..... 72/353.4
5,697,245 A * 12/1997 Maeng ..... 72/353.4

FOREIGN PATENT DOCUMENTS

JP Y2718448 5/1995
JP B22729852 12/1997

* cited by examiner

*Primary Examiner*—Lowell A. Larson
(74) *Attorney, Agent, or Firm*—Birch, Stewart, Kolasch & Birch, LLP

(57) ABSTRACT

In order to obtain uniform pressing force applied to a workpiece by an ironing die and easily disengage the workpiece after completing plastic working for the workpiece, a forming machine for performing the plastic working for the workpiece has a base pedestal, a forming punch provided on the base pedestal, and an annular ironing die arranged over the forming punch. The forming punch comprises a main punch body, six punch collets to be engaged with the main punch body and separated from each other at equal angles, a metal sleeve externally fitted to the main punch body and the punch collets, and a holder for holding the metal sleeve.

10 Claims, 15 Drawing Sheets

FORMING MACHINE

BACKGROUND OF THE INVENTION

1. Field of the Invention

The present invention relates to a forming machine for performing plastic working for a workpiece to have a predetermined shape by applying pressing force to the workpiece by using an ironing die.

2. Description of the Related Art

For example, a forming machine, which is disclosed in Japanese Patent No. 2729852, is known as a forming machine for performing plastic working for an outer wheel of a constant velocity universal joint which is used to drive wheels of an automobile.

As shown in FIG. 13, the forming machine A is used as follows. That is, a workpiece D, for example, an outer wheel for a ball joint is fitted to the forward end of a main punch body C which constitutes a forming punch B. An ironing die E is moved downwardly to apply the pressing force to the workpiece D so that the inner circumferential surface of the workpiece D is subjected to plastic working to have a predetermined shape. The main punch body C is formed with a plurality of sliding contact surfaces F each of which is inclined by a predetermined angle in a direction to make approach to the axis as the position on the sliding contact surface F approaches the forward end of the main punch body C. Punch collets G, which are opposed to one another, are fitted to make sliding contact with the respective sliding contact surfaces F. The forward end of the punch collet G has a shape corresponding to the predetermined shape so that the inner circumferential surface of the workpiece D may be formed into the predetermined shape.

After the plastic working for the workpiece D is completed, an elevator plate I is moved upwardly in accordance with the action of a cylinder mechanism H so that the respective punch collets G, which are engaged with the forward end of the elevator plate I, are allowed to make sliding movement obliquely upwardly with respect to the axial direction along the sliding contact surfaces F. When the movement in the obliquely upward direction is effected, the distances between the forward ends of the respective punch collets G are narrowed as a whole. As a result, the workpiece D, which is fitted to the forward end of the main punch body C, can be disengaged from the main punch body C. That is, as the punch collets G make the sliding movement, the distances between the forward ends of the mutually opposing punch collets G are narrowed. A gap J is finally formed between the workpiece D after the plastic working and the punch collets G (see FIG. 14). The gap J is utilized to disengage the workpiece D after the plastic working from the punch collets G. The disengaged workpiece D is transported to aftertreatment steps by the aid of a transport apparatus (not shown).

A forming punch, which is disclosed in Japanese Utility Model Publication No. 7-18448, is known as a forming punch for constructing a forming machine.

As shown in FIG. 15, the forming punch K has a main body section M which is formed with a female section L, and a head O which is formed with a male section N. In this form, the male section N is fitted to the female section L.

Further, a plurality of recessed grooves P are formed on an inner circumferential surface of the female section L. A plurality of recessed grooves Q, which are opposed to the recessed grooves P, are formed in the circumferential direction on an outer circumferential surface of the male section N. Key members R are fitted so that they range over the recessed grooves P and Q. The main body section M is provided with screw holes S in the diametric directions to face the aligned recessed grooves P and Q. Holding bolts T are screwed into the screw holes S. The head O is joined to the main body section M by pressing the key members R with the holding bolts T.

SUMMARY OF THE INVENTION

The present invention has been made in relation to the conventional forming machine described above, a general object of which is to provide a forming machine in which no complicated arrangement such as a cylinder mechanism is adopted, and hence an arrangement of the forming machine itself is simplified, making it possible to realize a small size and an inexpensive price.

A principal object of the present invention is to provide a forming machine which is excellent in versatility in which the forming step itself is quickened, making it possible to respond to the machining for a variety of workpieces.

Another object of the present invention is to provide a forming machine which makes it possible to suppress the occurrence of any axial deviation between an ironing die and a forming punch as less as possible, which makes it possible to improve the accuracy of plastic working for a workpiece by substantially uniformly applying the pressing force applied to the workpiece by the ironing die, and which makes it possible to easily disengage the workpiece after completing the plastic working for the workpiece.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

The forming machine according to the present invention will be explained in detail below with reference to the accompanying drawings FIGS. 1 to 6 as exemplified by preferred embodiments. The way of use of the forming machine is not limited. However, for example, the forming machine is preferably used in order to produce an outer wheel of a constant velocity universal joint which is used to drive wheels of an automobile.

Figure 1:
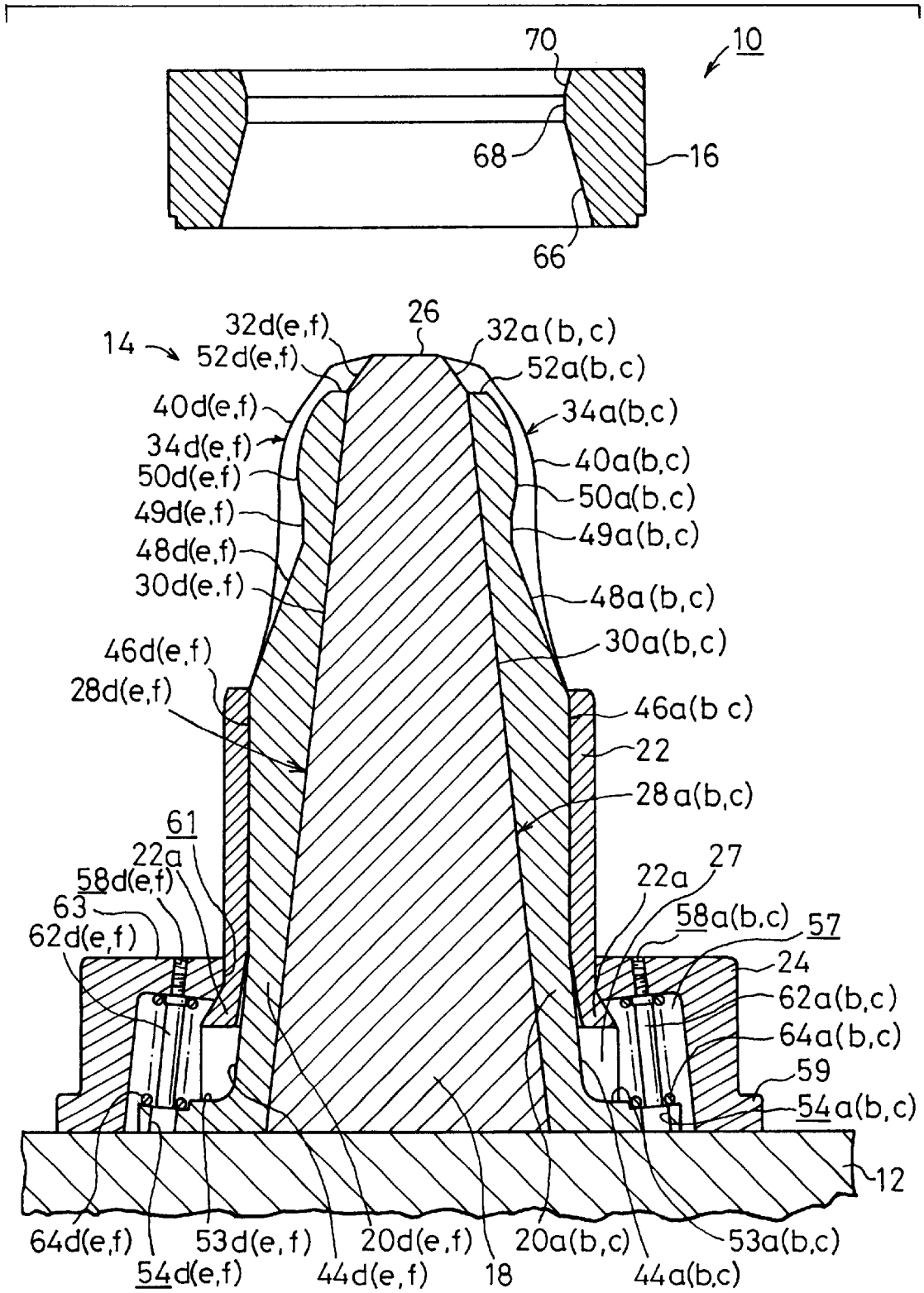
FIG. 1 shows a vertical sectional view illustrating a forming machine according to an embodiment of the present invention.

As shown in FIG. 1, a forming machine 10 according to ran embodiment of the present invention has a base pedestal 12, a forming punch 14 which is provided on the base pedestal 12, and an annular ironing die 16 which is arranged over the forming punch 14.

Figure 2:
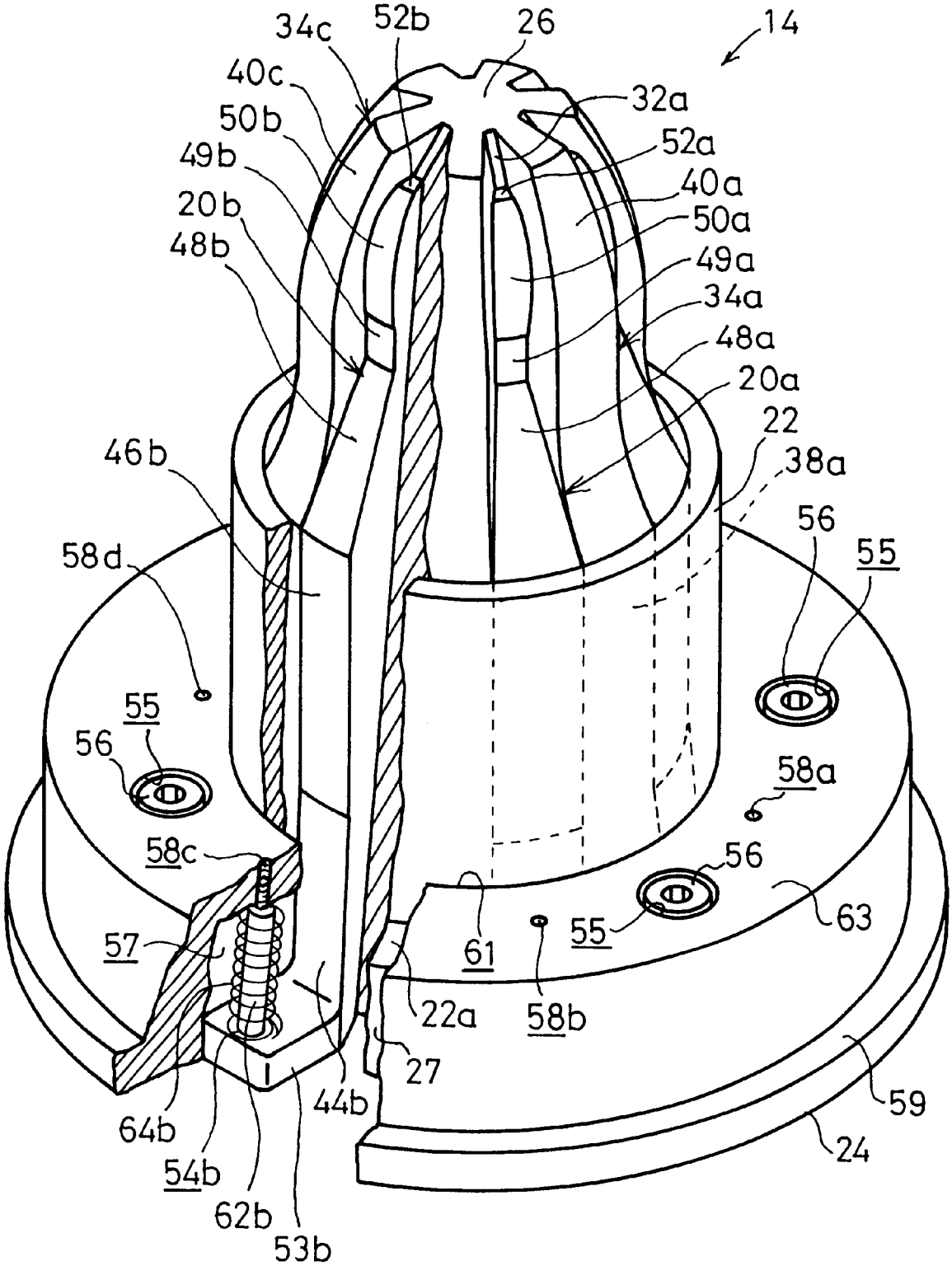
FIG. 2 shows, with partial cross section, a perspective view illustrating a forming punch to be used in the embodiment of the present invention.

As shown in FIGS. 1 and 2, the forming punch 14 comprises a main punch body 18, six punch collets 20*a* to 20*f* which are engaged with the main punch body 18 and which are separated from each other at equal angles, a metal sleeve 22 which is externally fitted to the main punch body 18 and the punch collets 20*a* to 20*f*, and a holder 24 which fastens the metal sleeve 22.

The main punch body 18 is made of high speed steel, and it has a substantially truncated cone-shaped configuration. The forward end 26 of the main punch body 18 is formed to be substantially flat. A placement section 27 for placing the metal sleeve 22 thereon is provided at the other end. Three pairs of mutually opposing cutout grooves 28*a* to 28*f*, which are continuous from the forward end 26 to the placement section 27, are formed while being separated from each other at equal angles for each pair of the cutout grooves, i.e., 28*a* and 28*d*, 28*b* and 28*e*, and 28*c* and 28*f*.

The cutout groove 28*a* to 28*f* has a lateral cross section which has a substantially wedge-shaped configuration. The cutout groove 28*a* to 28*f* is defined by a sliding contact surface 30*a* to 30*f* which is inclined by a predetermined angle in a direction to make approach to the axis of the main punch body 18 (oblique direction with respect to the axis), and a tapered surface 32*a* to 32*f* which is further inclined from the sliding contact surface 30*a* to 30*f* toward the axial direction of the main punch body 18 (see FIGS. 1 and 2).

A straight section 38*a* to 38*f* which extends vertically upwardly from the abutment surface with respect to the base pedestal 12, and a forming section 40*a* to 40*f* which is continuous from the straight section 38*a* to 38*f* to the forward end 26 are formed on each of ridges 34*a* to 34*f* which are interposed between the respective cutout grooves 28*a* to 28*f* (see FIGS. 1 and 2). The surface of the straight section 38*a* to 38*f* is highly accurately polished. On the other hand, the forming section 40*a* to 40*f* has a predetermined curved configuration in order to machine the inner circumferential surface of a workpiece W as described later on.

Three pairs of the punch collets 20*a* to 20*f* are arranged in the respective cutout grooves 28*a* to 28*f* while being separated from each other at equal angles and being opposed to one another for each pair of the punch collets, i.e., 20*a* and 20*d*, 20*b* and 20*e*, and 20*c* and 20*f* so that they are fitted to make sliding movement, in the same manner as the cutout grooves 28*a* to 28*f* described above.

Each of the punch collets 20*a* to 20*f* has a leg 44*a* to 44*f* which abuts against the base pedestal 12, a straight section 46*a* to 46*f* which extends in the vertical direction from the leg 44*a* to 44*f*, a tapered section 48*a* to 48*f* which is inclined by a predetermined angle with respect to the axis of the main punch body 18 from the end of the straight section 46*a* to 46*f*, a flat section 49*a* to 49*f* which extends from the tapered section 48*a* to 48*f*, and a curved section 50*a* to 50*f* which is continuous from the flat section 49*a* to 49*f* to a forward end surface 52*a* to 52*f* perpendicular to the axis of the main punch body 18.

A hole 54*a* to 54*f* is formed through a holding section 53*a* to 53*f* of the leg 44*a* to 44*f*, the holding section 53*a* to 53*f* extending in the expanding direction as shown in the drawings (see FIGS. 1 and 2). As easily and clearly understood from FIGS. 5 and 6 as well, the axis of the hole 54*a* to 54*f* extends at an angle parallel to the sliding contact surface 30*a* to 30*f*.

The surface of the straight section 46*a* to 46*f*, which is formed on the punch collet 20*a* to 20*f*, is highly accurately polished beforehand, in the same manner as the straight section 38*a* to 38*f* formed on the ridge 34*a* to 34*f*. The annular metal sleeve 22, which has a pawl 22*a* at its first end, is externally fitted to the straight sections 38*a* to 38*f* provided for the ridges 34*a* to 34*f* of the main punch body 18 and the straight sections 46*a* to 46*f* provided for the punch collets 20*a* to 20*f*, in order to coaxially hold the main punch body 18 and the respective punch collets 20*a* to 20*f* as described above (see FIGS. 1 and 2). The metal sleeve 22 is placed on the placement section 27 formed for the main punch body 18, and the circumference of the metal sleeve 22 is held by the holder 24.

A chamber 57 is formed at the inside of the holder 24. The holder 24 has a pawl 59 which is disposed around the lower end, and it has an opening 61 which is disposed at a substantially central portion thereof. The pawl 59 is placed on the base pedestal 12. The main punch body 18 and the punch collets 20*a* to 20*f*, to which the metal sleeve 22 is externally fitted, penetrate through the opening 61. A plurality of bolt holes 55, which are arranged at equal intervals, are bored through a top flat surface 63 of the holder 24. Bolts 56 are allowed to penetrate through the bolt holes 55 to fix the holder 24 to the base pedestal 12 by means of screwing attachment (see FIG. 2).

Figure 3:
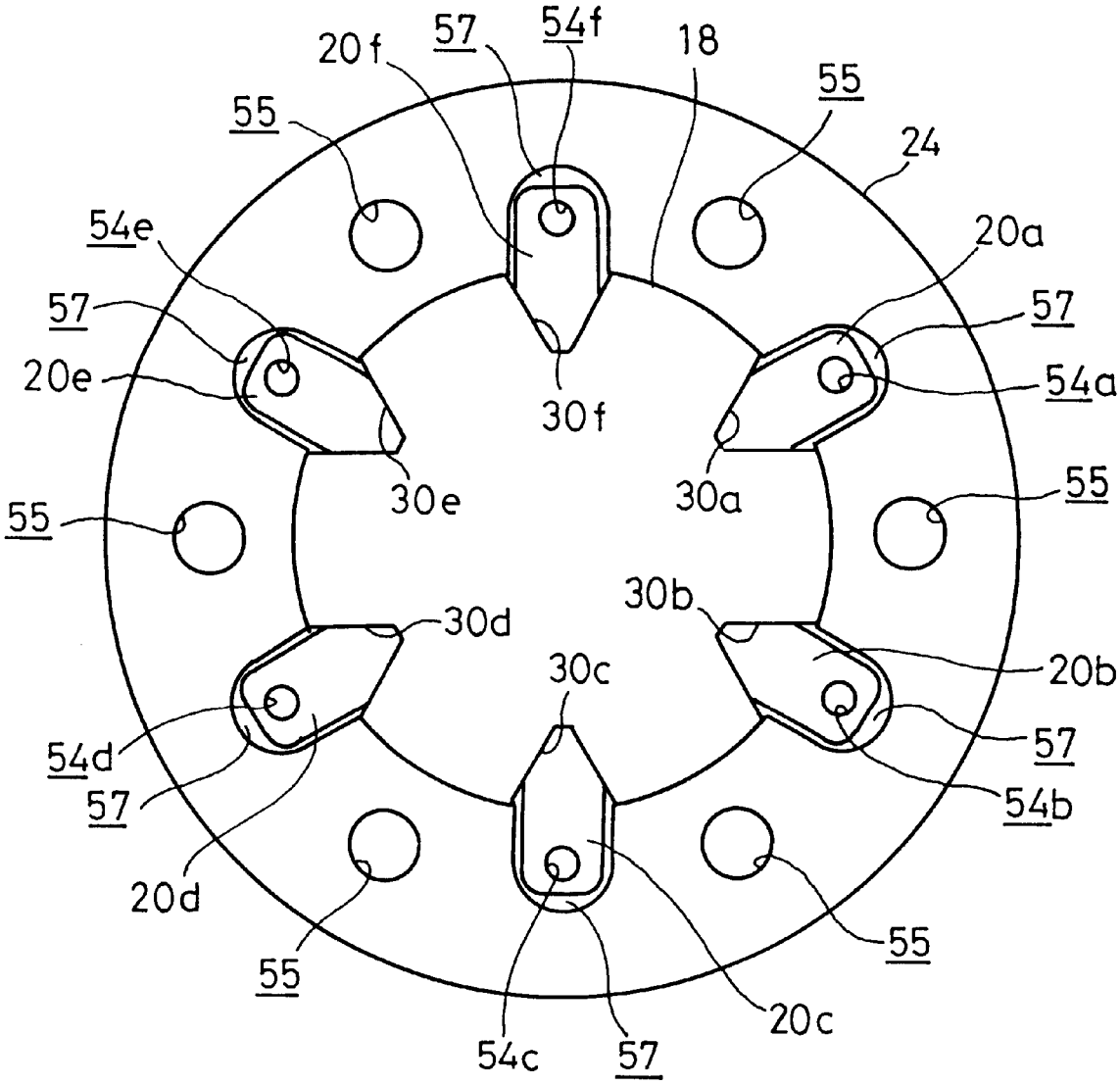
FIG. 3 shows a bottom view illustrating the forming punch.

A plurality of screw holes 58*a* to 58*f*, which are separated from each other at equal angles, are formed through the top flat surface 63 of the holder 24 about the center of the axis of the main punch body 18 (see FIGS. 2 and 3). The angle of inclination of each of the screw holes 58*a* to 58*f* is substantially the same as that of each of the holes 54*a* to 54*f*.

First ends of guide pins 62*a* to 62*f* in the chamber 57 are screwed into the screw holes 58*a* to 58*f*. Second ends of the guide pins 62*a* to 62*f* are faced to and inserted into holes 54*a* to 54*f* which are formed through the holding sections 53*a* to 53*f* of the punch collets 20*a* to 20*f* (see FIGS. 1 and 2).

A coil spring 64*a* to 64*f*, which is seated on the inner wall of the holder 24 and the holding section 53*a* to 53*f*, is wound around the guide pin 62*a* to 62*f*. The hole 54*a* to 54*f*, the screw hole 58*a* to 58*f*, and the sliding contact surface 30*a* to 30*f* of the cutout groove 28*a* to 28*f* formed on the main punch body 18 are in a relationship of being mutually closest to one another, and they are inclined at the identical angle with respect to the axis of the main punch body 18.

Therefore, they are in a parallel state. Accordingly, the guide pin 62*a* to 62*f*, the coil spring 64*a* to 64*f*, and the sliding contact surface 30*a* to 30*f* are inclined in parallel to one another in the same manner as described above (see FIGS. 1 and 2).

As shown in FIG. 1, the ironing die 16 has a first tapered section 66 which is inclined by a predetermined angle in a direction to make mutual approach to the axis of the ironing die 16, a straight section 68 which extends vertically upwardly from the first tapered section 66, and a second tapered section 70 which extends from the straight section 68 and which is inclined by a predetermined angle in a direction to make mutual separation from the axis of the ironing die 16. The ironing die 16 is connected to a driving mechanism (not shown). The ironing die 16 is movable upwardly and downwardly in the axial direction of the forming punch 14 in accordance with the action of the driving mechanism.

The forming machine 10 according to the embodiment of the present invention is basically constructed as described above. Next, its function and effect will be explained.

Figure 4:
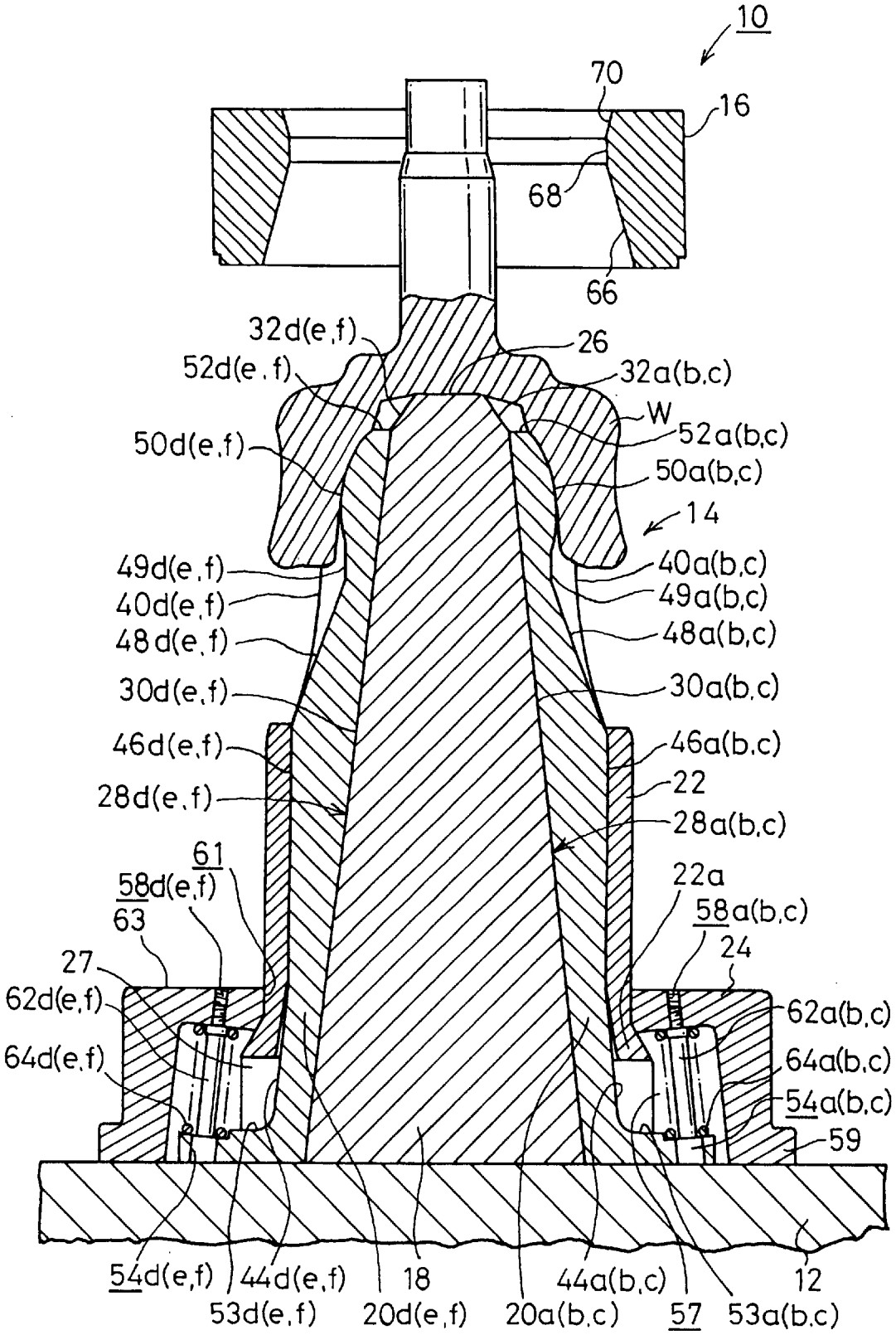
FIG. 4 illustrates a state in which a workpiece is fitted to the forming punch.

At first, as shown in FIG. 4, the workpiece W is fitted to the forming punch 14 by the aid of a transport mechanism (not shown) so that the workpiece W is opposed to the forward end 26 of the main punch body 18 which constitutes the forming punch 14. In this procedure, the inner circumferential surface of the workpiece W is coarsely machined beforehand so that the inner circumferential surface of the workpiece W is fitted to the forming sections 40*a* to 40*f* which are formed on the ridges 34*a* to 34*f* for constructing the main punch body 18 and the curved sections 50*a* to 50*f* which are formed on the punch collets 20*a* to 20*f*.

Figure 5:
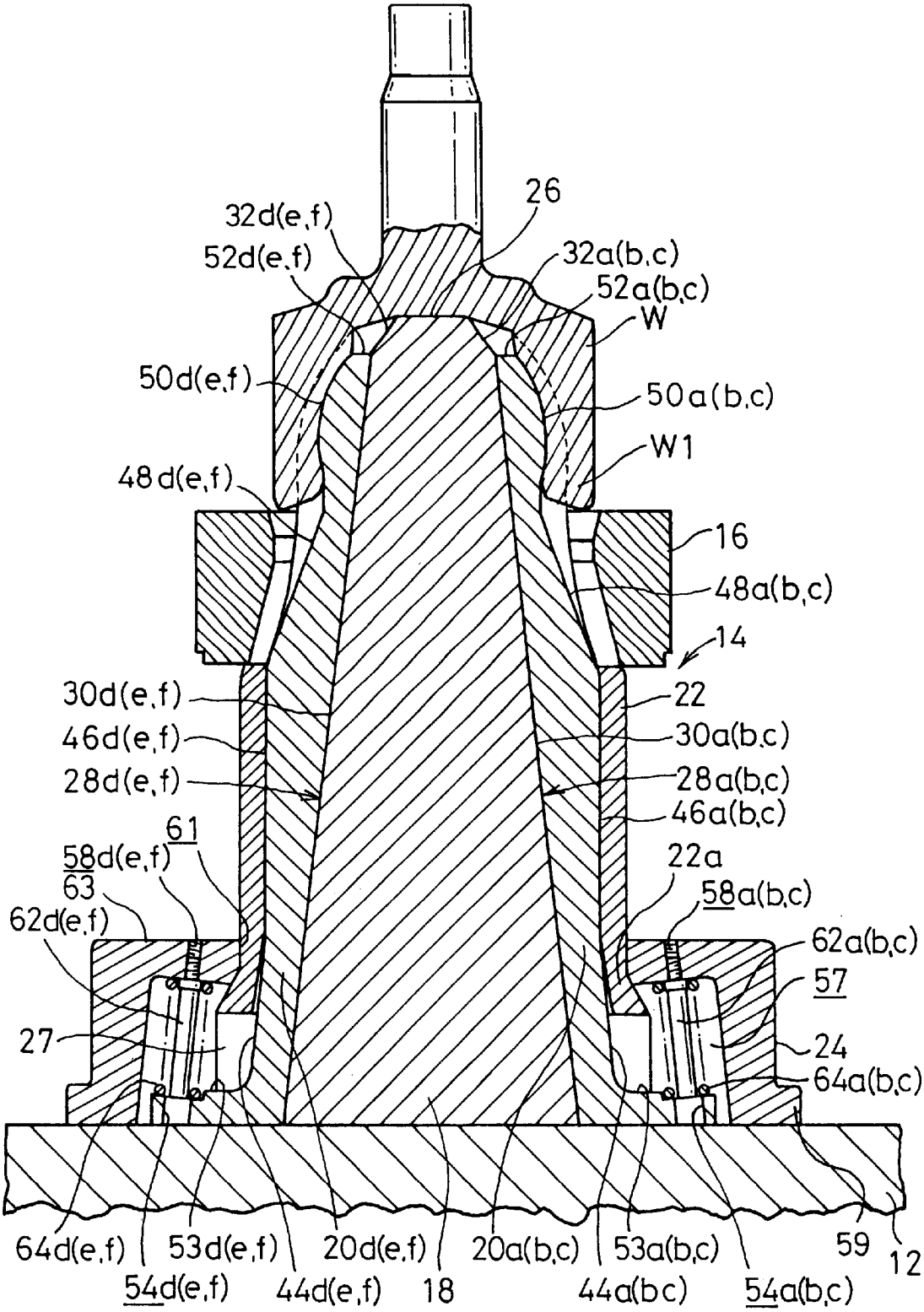
FIG. 5 illustrates a state immediately after the workpiece is machined.
Figure 6:
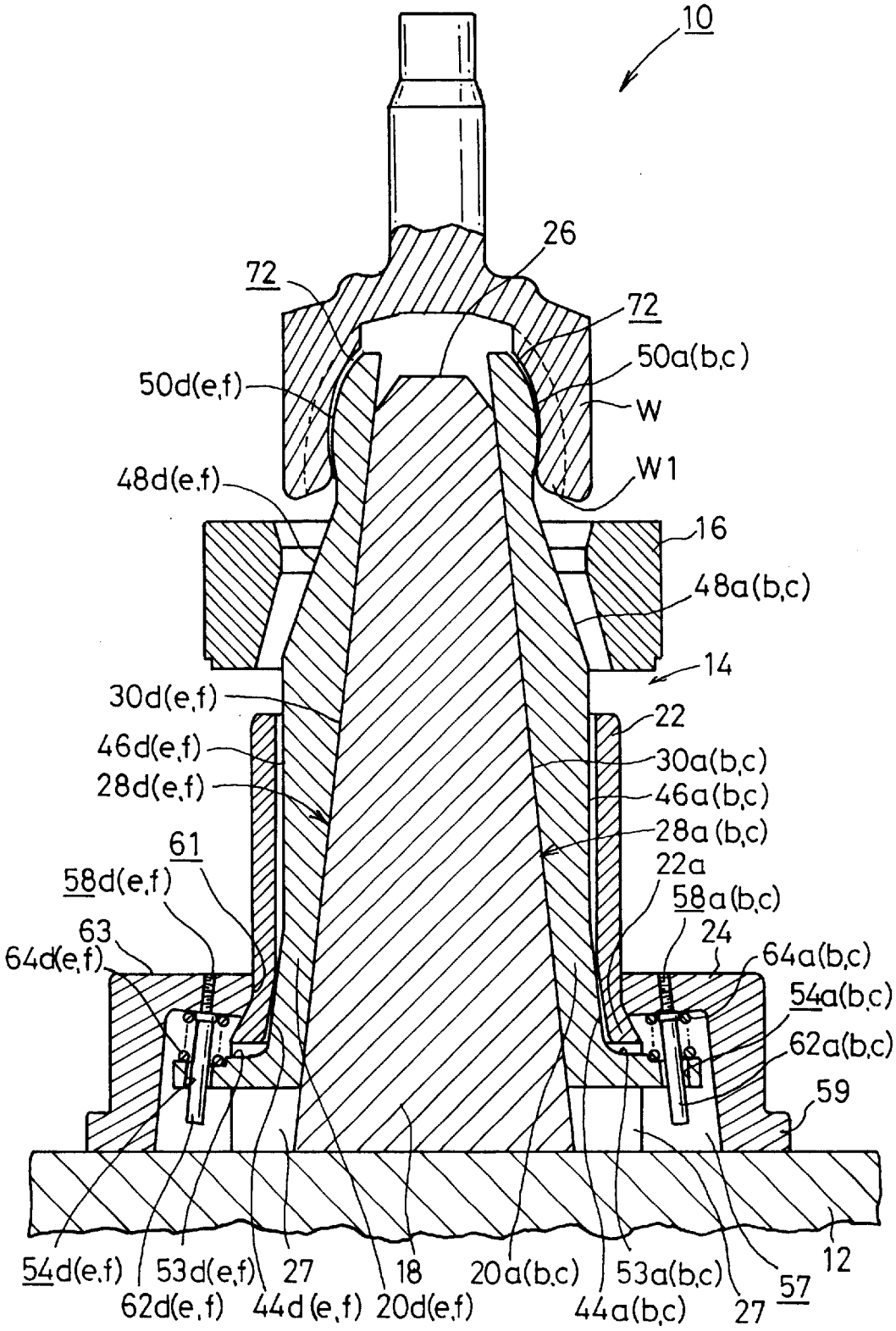
FIG. 6 illustrates a state immediately before the workpiece is disengaged from the forming punch.

Subsequently, as shown in FIG. 5, the ironing die 16 is moved downwardly in the axial direction of the main punch body 18 in accordance with the action of the driving mechanism (not shown) while applying the pressing force to the outer circumferential surface of the workpiece W. Accordingly, a state is given, in which the workpiece W is interposed between the ironing die 16 and the forming sections 40*a* to 40*f* provided for the ridges 34*a* to 34*f* and the curved sections 50*a* to 50*f* provided for the punch collets 20*a* to 20*f*. The inner circumferential surface of the workpiece W is subjected to the plastic working to have a predetermined shape by the aid of the forming sections 40*a* to 40*f*. During this process, an undercut section W1 is formed on the workpiece W so that the undercut section W1 is coincident with the shape of the curved sections 50*a* to 50*f*.

After the plastic working for the workpiece W is completed, the workpiece W is displaced vertically upwardly in accordance with the action of the transport mechanism (not shown). During this process, the undercut section W1, which is formed on the workpiece W as described above, allows the workpiece W to be fastened by the punch collets 20*a* to 20*f*. Thus, the punch collets 20*a* to 20*f* follow the workpiece W, and they make sliding movement in the upward direction along the sliding contact surfaces 30*a* to 30*f*.

In accordance with the sliding movement of the punch collets 20*a* to 20*f* on the sliding contact surfaces 30*a* to 30*f*, the coil springs 64*a* to 64*f*, which are seated on the holder 24 and the upper surfaces of the holding sections 53*a* to 53*f* of the punch collets 20*a* to 20*f*, are contracted. Accordingly, a state is given, in which the guide pins 62*a* to 62*f*, which are screwed and attached to the holder 24, penetrate through the holes 54*a* to 54*f* which are formed through the holding sections 53*a* to 53*f* (see FIG. 6).

The sliding contact surfaces 30*a* to 30*f* are formed so that they are inclined by the predetermined angle in the direction to make approach to the axis of the main punch body 18. Therefore, as the punch collets 20*a* to 20*f* slide upwardly on the sliding contact surfaces 30*a* to 30*f*, the distances between the forward ends of the mutually opposing punch collets 20*a* to 20*f* are narrowed as a whole. As a result, when the workpiece W is displaced by a predetermined distance, a gap 72 is formed between the workpiece W and the punch collets 20*a* to 20*f* (see FIG. 6). The workpiece W can be disengaged from the punch collets 20*a* to 20*f* with ease by utilizing the gap 72.

The disengaged workpiece W is transported to the after-treatment step by the aid of the transport mechanism (not shown), to which a predetermined aftertreatment is applied.

Simultaneously with the disengagement of the workpiece W from the punch collets 20*a* to 20*f*, the punch collets 20*a* to 20*f* make sliding movement in the downward direction along the sliding contact surfaces 30*a* to 30*f* in accordance with the action of the resilient force of the coil springs 64*a* to 64*f*. The resilient force is applied until the punch collets 20*a* to 20*f* are returned to the positions of the state before the workpiece W is fitted to the forming punch 14.

In the embodiment of the present invention, the metal sleeve 22 is externally fitted to the straight sections 38*a* to 38*f* and 46*a* to 46*f* which are formed on the main punch body 18 and the punch collets 20*a* to 20*f* respectively. Therefore, the punch collets 20*a* to 20*f* are reliably maintained coaxially with the main punch body 18. Further, the surfaces of the straight sections 38*a* to 38*f* and 46*a* to 46*f* are highly accurately polished as described above. Therefore, it is possible to make the contact without providing any gap between the main punch body 18 and the punch collets 20*a* to 20*f* and the metal sleeve 22.

Therefore, it is possible to suppress the occurrence of any axial deviation between the ironing die 16 and the main punch body 18 to which the punch collets 20*a* to 20*f* are fitted as less as possible. Accordingly, when the pressing force is applied to the workpiece W by using the ironing die 16, the pressing force can be applied to the workpiece W substantially uniformly. Therefore, it is possible to highly accurately perform the plastic working for the workpiece W. As a result, it is possible to easily machine the workpiece W in the aftertreatment steps.

In the embodiment of the present invention, when the workpiece W is disengaged from the forming machine 10 after completing the plastic working for the workpiece W, then the workpiece W is displaced in accordance with the action of the transport mechanism (not shown), and the punch collets 20*a* to 20*f* are allowed to make the sliding movement in the upward direction along the sliding contact surfaces 30*a* to 30*f* formed on the main punch body 18 so as to follow the displacement of the workpiece W. Accordingly, the gap 72 is formed between the workpiece W and the punch collets 20*a* to 20*f*. The workpiece W can be easily disengaged from the punch collets 20*a* to 20*f* by utilizing the gap 72.

In the embodiment of the present invention, the guide pins 62*a* to 62*f*, the coil springs 64*a* to 64*f*, and the sliding contact surfaces 30*a* to 30*f* are in the parallel state. Therefore, when the punch collets 20*a* to 20*f* make the sliding movement along the sliding contact surfaces 30*a* to 30*f*, it is possible to smoothly make the sliding movement without applying any excessive load on the punch collets 20*a* to 20*f*. After the workpiece W is disengaged, the punch collets 20*a* to 20*f* are forcibly restored to the original positions in accordance with the action of the resilient force of the coil springs 64*a* to 64*f*.

Figure 7:
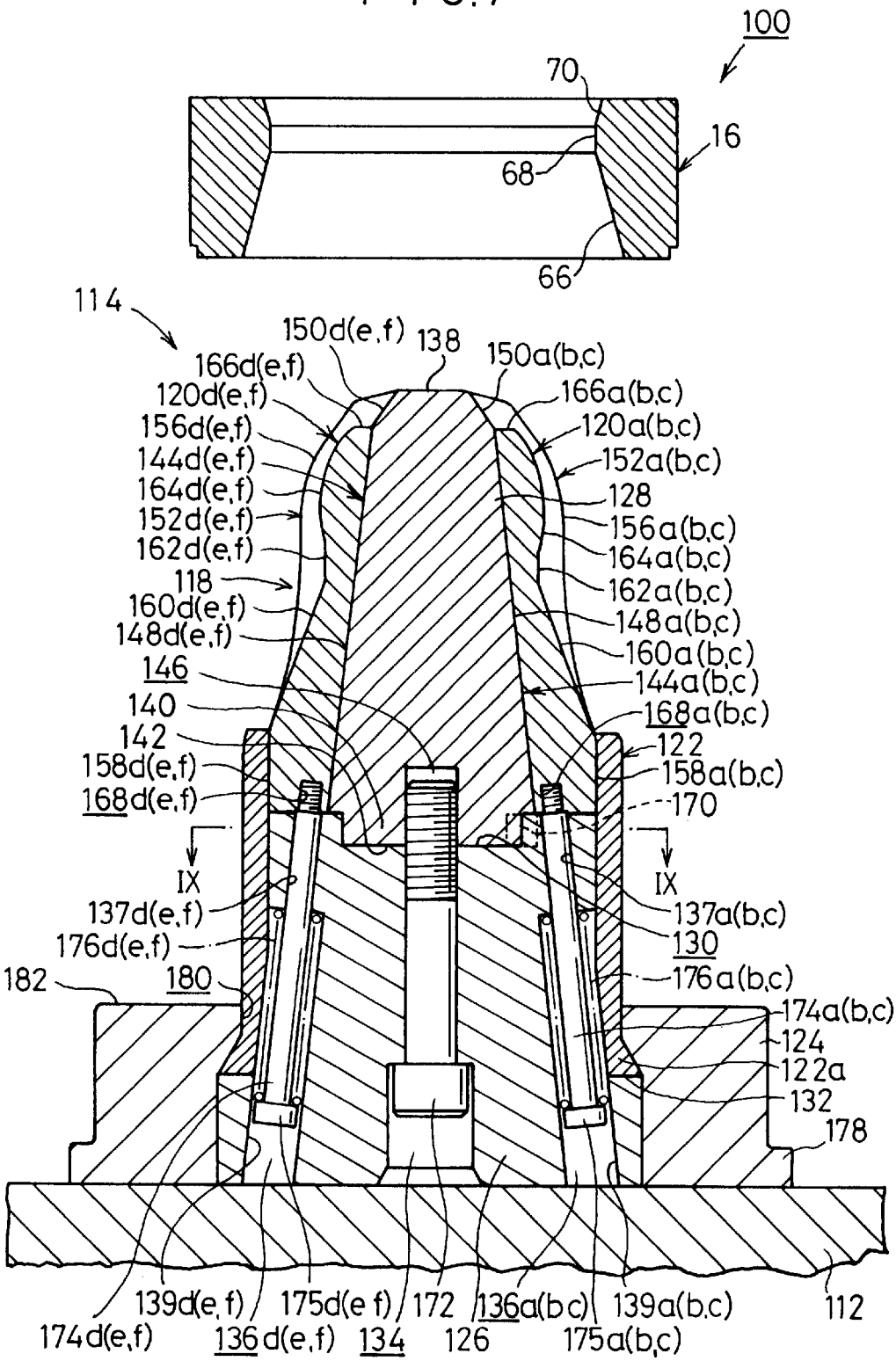
FIG. 7 shows a vertical sectional view illustrating a forming machine according to another embodiment.

Another embodiment of the forming machine according to the present invention is shown in FIG. 7 and followings.

As shown in FIG. 7, a forming machine 100 according to this embodiment of the present invention has a base pedestal 112, a forming punch 114 which is provided on the base pedestal 112, and an annular ironing die 16 which is arranged over the forming punch 114. The ironing die 16 is the same as the ironing die to be used for the forming machine shown in FIGS. 1 to 6 having been already explained.

Therefore, the same conformational portions are designated by the same reference numerals, detailed explanation of which will be omitted.

Figure 8:
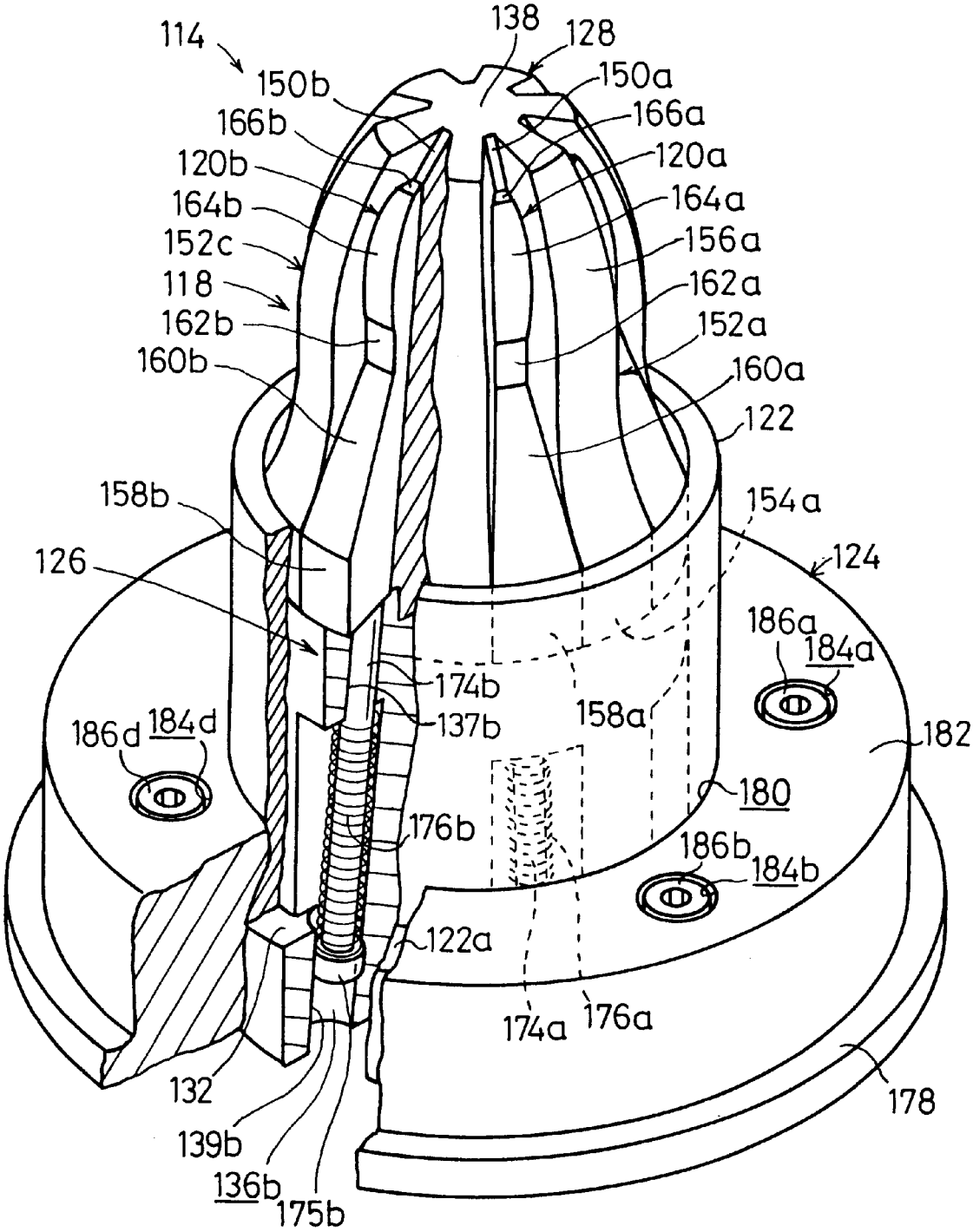
FIG. 8 shows, with partial cross section, a perspective view illustrating the forming punch shown in FIG. 7.

As shown in FIGS. 7 and 8, the forming punch 114 comprises a main punch body 118, six punch collets 120*a* to 120*f* which are engaged with the main punch body 118 and which are separated from each other at equal angles, a metal sleeve 122 which is externally fitted to the main punch body 118 and the punch collets 120*a* to 120*f*, and a holder 124 which fastens the metal sleeve 122.

The main punch body 118 is formed to have a substantially truncated cone-shaped configuration, and it comprises a punch base 126 made of die steel, and a mandrel 128 made of high speed steel. A recess 130 is formed at the upper end of the punch base 126. An annular placement section 132 for placing the metal sleeve 122 thereon is provided at the lower end so that the placement section 132 protrudes outwardly. A first fastening hole 134 is defined at a substantially central portion in the axial direction of the punch base 126 so that the first fastening hole 134 penetrates through the punch base 126 (see FIG. 7).

The punch base 126 is formed with a plurality of holes 136*a* to 136*f* which are disposed around the center of the axis of the punch base 126 and which are separated from each other at equal angles. The hole 136*a* to 136*f* is composed of a small diameter section 137*a* to 137*f*, and a large diameter section 139*a* to 139*f* which is formed to have a diameter larger than that of the small diameter section 137*a* to 137*f*. The axis of the hole 136*a* to 136*f* is inclined by a predetermined angle in a direction to make approach to the axis of the punch base 126 and the mandrel 128 (oblique direction with respect to the axis).

The mandrel 128 has a first end 138 which is formed to be substantially flat, and a projection 142 which is provided at a second end 140 and which is fitted to the recess 130. Six cutout grooves 144*a* to 144*f*, which range from the first end 138 to the second end 140, are provided on the outer circumferential surface of the mandrel 128. In this arrangement, the cutout grooves 144*a* and 144*d*, 144*b* and 144*e*, 144*c* and 144*f* are arranged symmetrically with respect to the axis of the mandrel 128. The projection 142 is defined with a second fastening hole 146 which is opposed to the first fastening hole 134 (see FIG. 7).

The cutout groove 144*a* to 144*f* has a lateral cross section which has a substantially wedge-shaped configuration. The cutout groove 144*a* to 144*f* has a sliding contact surface 148*a* to 148*f* which is inclined by a predetermined angle in a direction to make approach to the axis of the mandrel 128 (oblique direction with respect to the axis). A tapered surface 150*a* to 150*f*, which is suddenly inclined in the axial direction of the mandrel 128, extends from the sliding contact surface 148*a* to 148*f* to the first end 138 (see FIGS. 7 and 8). The angle of inclination of the sliding contact surface 148*a* to 148*f* with respect to the axis of the mandrel 128 is set to be the same angle as the angle of inclination of the axis of the hole 136*a* to 136*f* with respect to the axis of the punch base 126. Therefore, the axes of the holes 136*a*, 136*b*, 136*c*, 136*d*, 136*e*, 136*f* and the sliding contact surfaces 148*a*, 148*b*, 148*c*, 148*d*, 148*e*, 148*f* are in a state of being parallel to one another.

A straight section 154*a* to 154*f* which extends vertically upwardly from the abutment surface with respect to the punch base 126, and a forming section 156*a* to 156*f* which is continuous from the straight section 154*a* to 154*f* to the first end 138 are formed on each of ridges 152*a* to 152*f* which are interposed between the respective cutout grooves 144*a* to 144*f* (see FIGS. 7 and 8). The surface of the straight section 154*a* to 154*f* is highly accurately polished. On the other hand, the forming section 156*a* to 156*f* has a predetermined curved configuration in order to machine the inner circumferential surface of a workpiece W as described later on.

The punch collets 120*a* to 120*f* are arranged in the respective cutout grooves 144*a* to 144*f* while being separated from each other at equal angles and being opposed to one another for each pair of the punch collets, i.e., 120*a* and 120*d*, 120*b* and 120*e*, and 120*c* and 120*f* so that they are fitted to make sliding movement, in the same manner as the cutout grooves 144*a* to 144*f* described above.

Each of the punch collets 120*a* to 120*f* has a leg 158*a* to 158*f* which abuts against the punch base 126, a tapered section 160*a* to 160*f* which is inclined by a predetermined angle in a direction to make approach with respect to the axis of the mandrel 128 from the end of the leg 158*a* to 158*f*, a flat section 162*a* to 162*f* which extends in the upward direction from the tapered section 160*a* to 160*f*, and a curved section 164*a* to 164*f* which is continuous from the flat section 162*a* to 162*f* to a forward end surface 166*a* to 166*f* perpendicular to the axis of the mandrel 128. A screw hole 168*a* to 168*f* is formed at a bottom surface of the leg 158*a* to 158*f* (see FIGS. 7 and 9). The surface of the leg 158*a* to 158*f*, which is formed on the punch collet 120*a* to 120*f*, is highly accurately polished beforehand, in the same manner as the straight section 154*a* to 154*f* formed on the ridge 152*a* to 152*f*.

Figure 9:
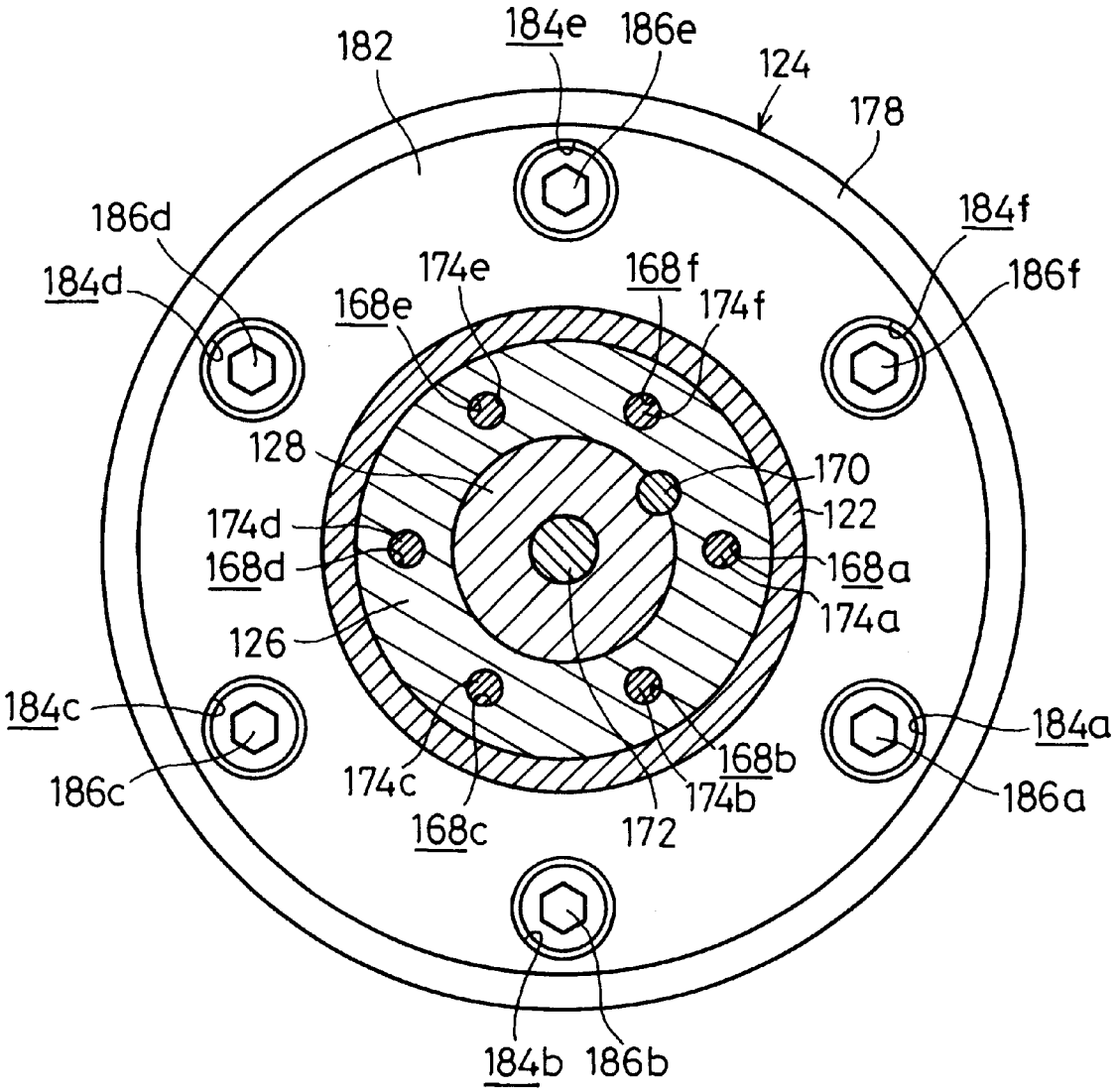
FIG. 9 shows a sectional view taken along a line IX—IX illustrating the forming punch shown in FIG. 7.

A positioning pin 170, which is used to center the punch base 126 and the mandrel 128, is inserted between the inner circumferential surface of the recess 130 and the outer circumferential surface of the projection 142 (see FIGS. 7 and 9). The axial centers of the punch base 126 and the mandrel 128 coincide with each other by the aid of the positioning pin 170. The punch base 126 and the mandrel 128 are joined to one another by a fastening bolt 172 which is screwed into the first fastening hole 134 and the second fastening hole 146.

A rod 174*a* to 174*f* penetrates through the inside of each of the holes 136*a* to 136*f* which are formed through the punch base 126. The rod 174*a* to 174*f* is screwed into the screw hole 168*a* to 168*f* formed at the bottom surface of the punch collet 120*a* to 120*f*. A coil spring 176*a* to 176*f*, which is seated on the upper surface of the large diameter section 139*a* to 139*f* of the hole 136*a* to 136*f* and a flange 175*a* to 175*f* of the rod 174*a* to 174*f*, is wound around the rod 174*a* to 174*f*.

As described above, the axes of the holes 136*a* to 136*f* and the sliding contact surfaces 148*a* to 148*f* are inclined at the same angle with respect to the axis of the punch base 126 and the mandrel 128 (axis of the main punch body 118). Therefore, the rods 174*a* to 174*f*, the coil springs 176*a* to 176*f*, and the sliding contact surfaces 148*a* to 148*f* are inclined in parallel to one another in the same manner as described above (see FIGS. 7 and 8).

The annular metal sleeve 122, which has a pawl 122*a* at its lower end, is externally fitted to the punch base 126, the straight sections 154*a* to 154*f* provided for the ridges 152*a* to 152*f* of the mandrel 128, and the legs 158*a* to 158*f* provided for the punch collets 120*a* to 120*f*, in order to coaxially hold the main punch body 118 and the punch collets 120*a* to 120*f* (see FIGS. 7 and 8). The pawl 122*a* of the metal sleeve 122 is placed on the placement section 132 formed for the punch base 126, and the circumference thereof is held by the holder 124.

The holder 124 has a pawl 178 which is disposed around the lower end, and it has an opening 180 having a large circular configuration which is disposed at its central portion. The pawl 178 is placed on the base pedestal 112. The metal sleeve 122 and the main punch body 118 are positioned in the opening 180. A plurality of bolt holes 184*a* to 184*f*, which are arranged at equal intervals, are bored through a top flat surface 182 of the holder 124. Bolts 186*a* to 186*f* are allowed to penetrate through the bolt holes 184*a* to 184*f* to fix the holder 124 to the base pedestal 112 by means of screwing attachment (see FIG. 8).

Next, explanation will be made for the function and effect of the forming machine constructed as described above.

Figure 10:
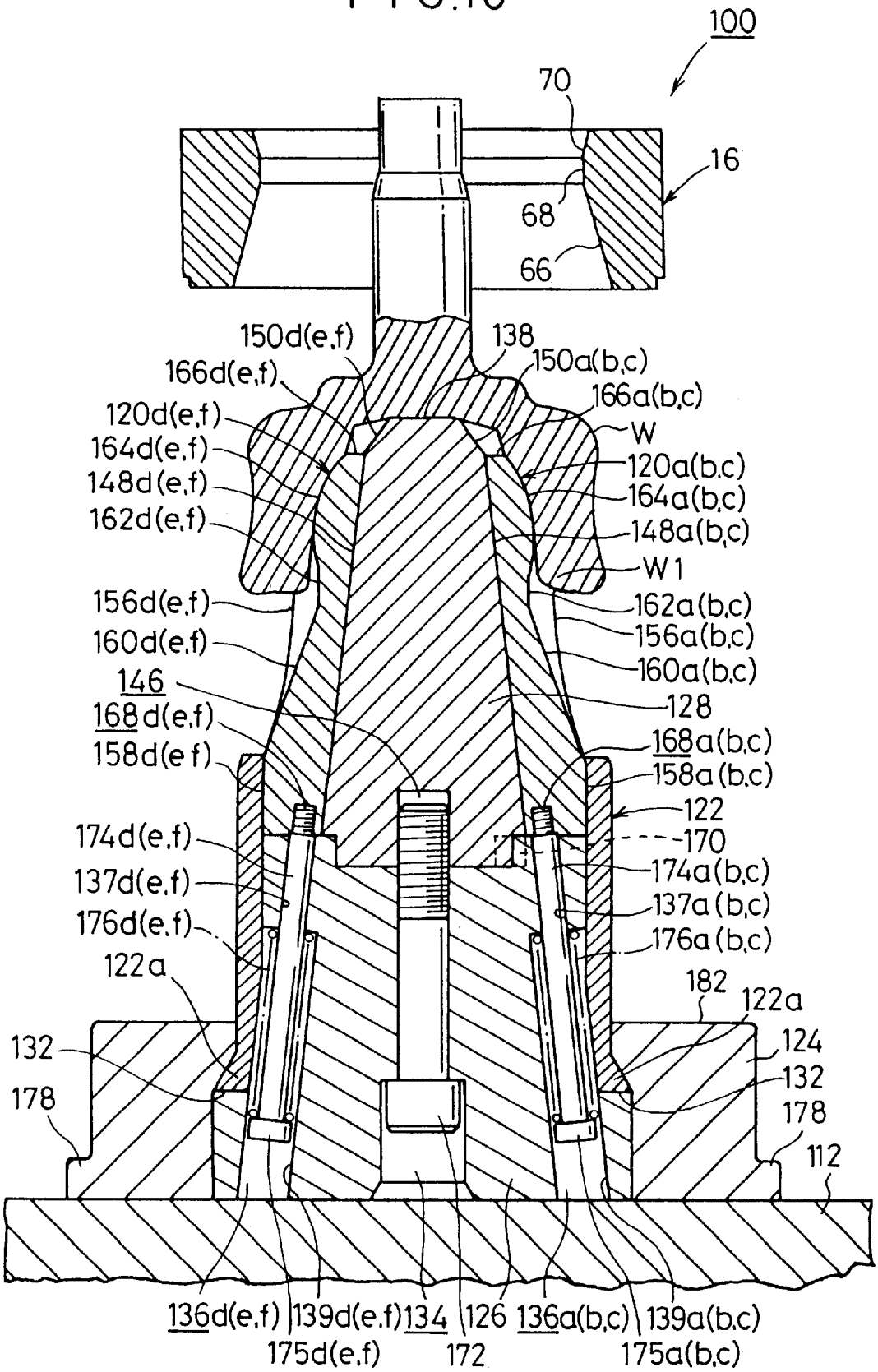
FIG. 10 illustrates a state in which a workpiece is fitted to the forming punch of the forming machine shown in FIG. 7.

At first, as shown in FIG. 10, the workpiece W is fitted to the forming punch 114 by the aid of a transport mechanism (not shown) so that the workpiece W is opposed to the first end 138 of the mandrel 128 of the main punch body 118 which constitutes the forming punch 114. In this procedure, the inner circumferential surface of the workpiece W is coarsely machined beforehand so that the inner circumferential surface of the workpiece W is fitted to the forming sections 156*a* to 156*f* which are formed on the ridges 152*a* to 152*f* of the mandrel 128 and the curved sections 164*a* to 164*f* which are formed on the punch collets 120*a* to 120*f*.

Figure 11:
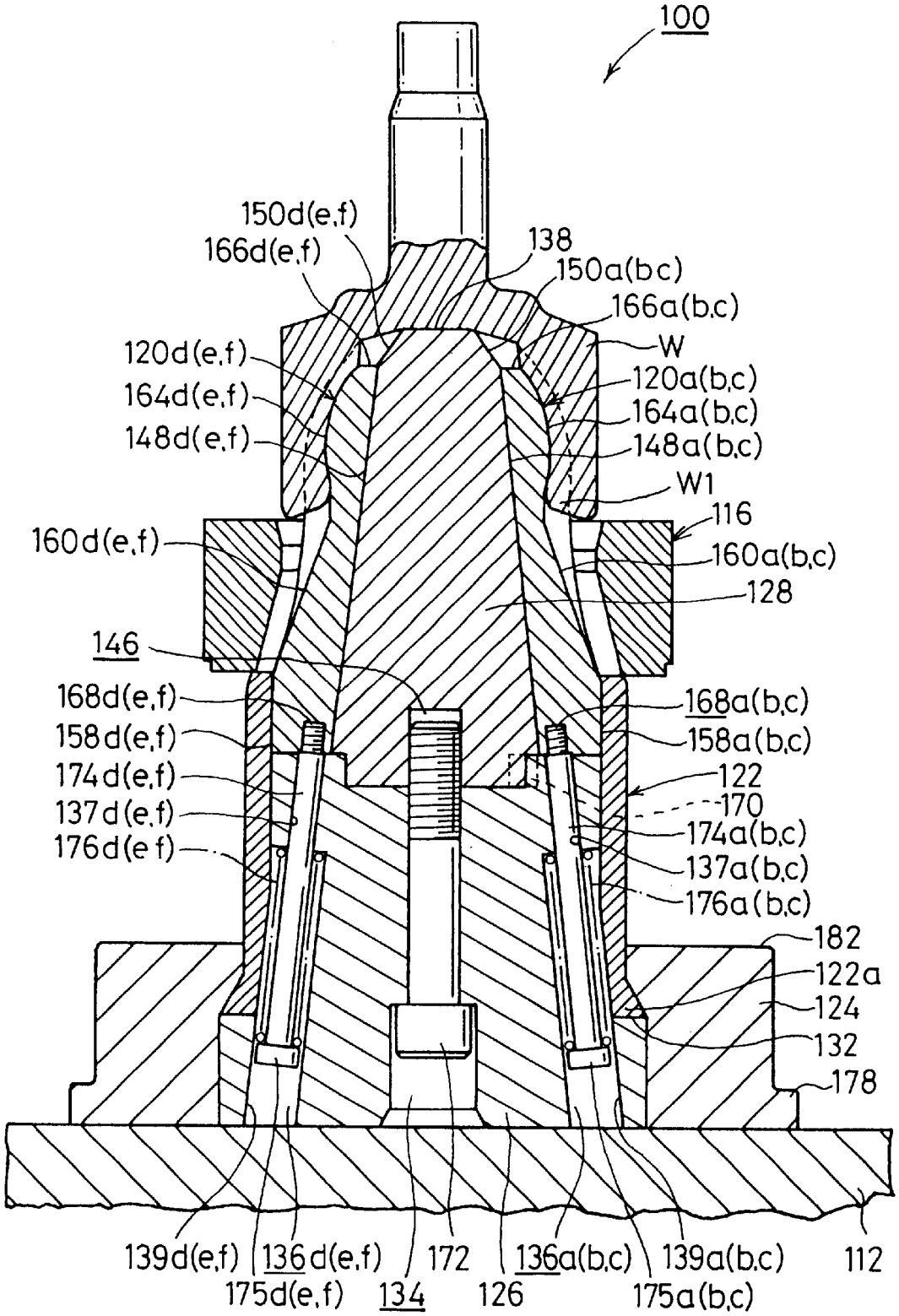
FIG. 11 illustrates a state immediately after the workpiece is machined with the forming machine shown in FIG. 7.

Subsequently, as shown in FIG. 11, the ironing die 16 is moved downwardly in the axial direction of the main punch body 118 in accordance with the action of the driving mechanism (not shown) while applying the pressing force to the outer circumferential surface of the workpiece W. Accordingly, a state is given, in which the workpiece W is interposed between the ironing die 16 and the forming sections 156*a* to 156*f* provided for the ridges 152*a* to 152*f* and the curved sections 164*a* to 164*f* provided for the punch collets 120*a* to 120*f*. The inner circumferential surface of the workpiece W is subjected to the plastic working to have a predetermined shape by the aid of the forming sections 156*a* to 156*f*. During this process, an undercut section W1 is formed on the workpiece W so that the undercut section W1 is coincident with the shape of the curved sections 164*a* to 164*f*.

After the plastic working for the workpiece W is completed, the workpiece W is displaced vertically upwardly in accordance with the action of the transport mechanism (not shown). During this process, the undercut section W1, which is formed on the workpiece W as described above, allows the workpiece W to be fastened by the punch collets 120*a* to 120*f*. The punch collets 120*a* to 120*f* follow the workpiece W, and they make sliding movement in the upward direction on the sliding contact surfaces 148*a* to 148*f* integrally with the workpiece W.

Figure 12:
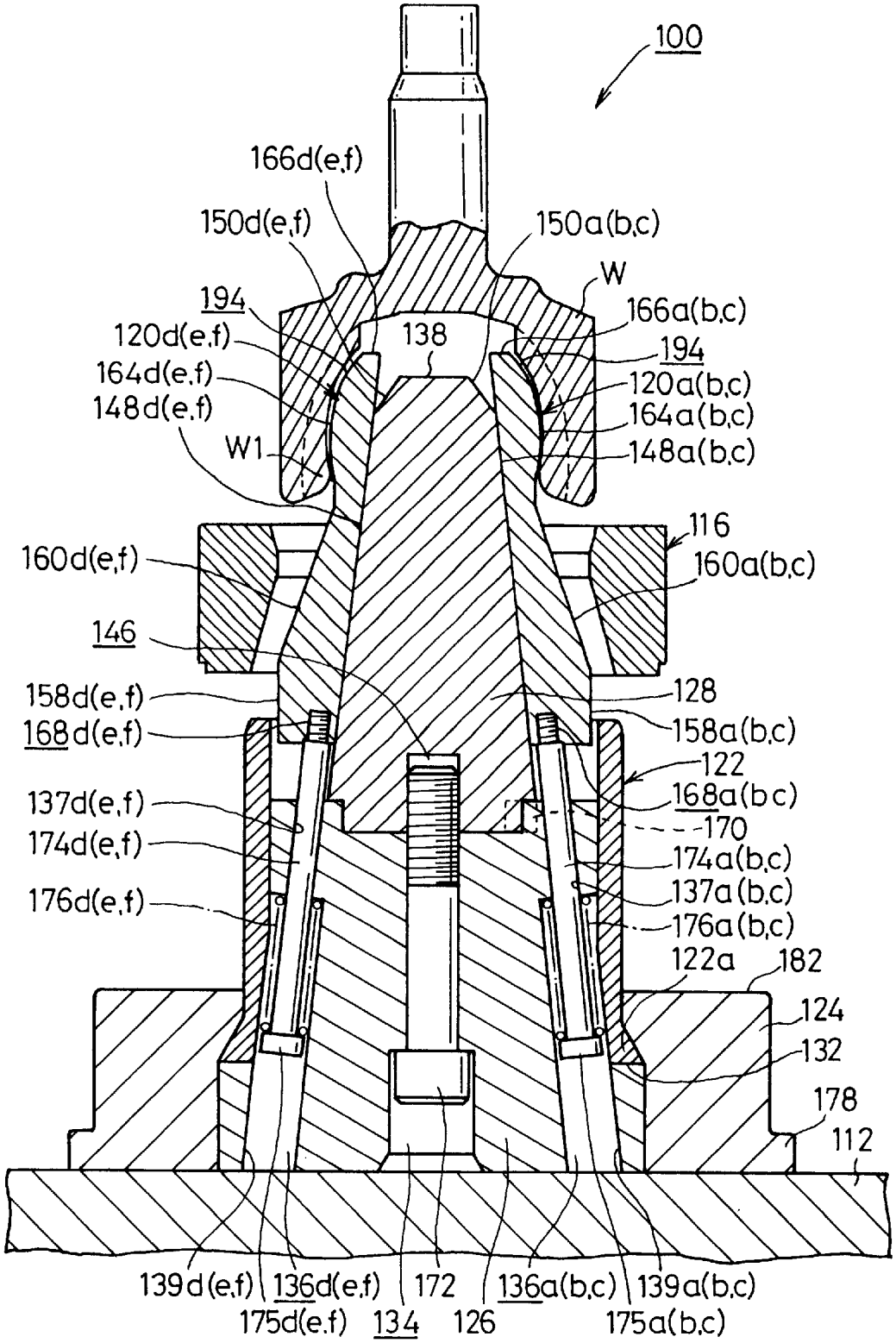
FIG. 12 illustrates a state immediately before the workpiece is disengaged from the forming punch concerning the forming machine shown in FIG. 7.
Figure 13:
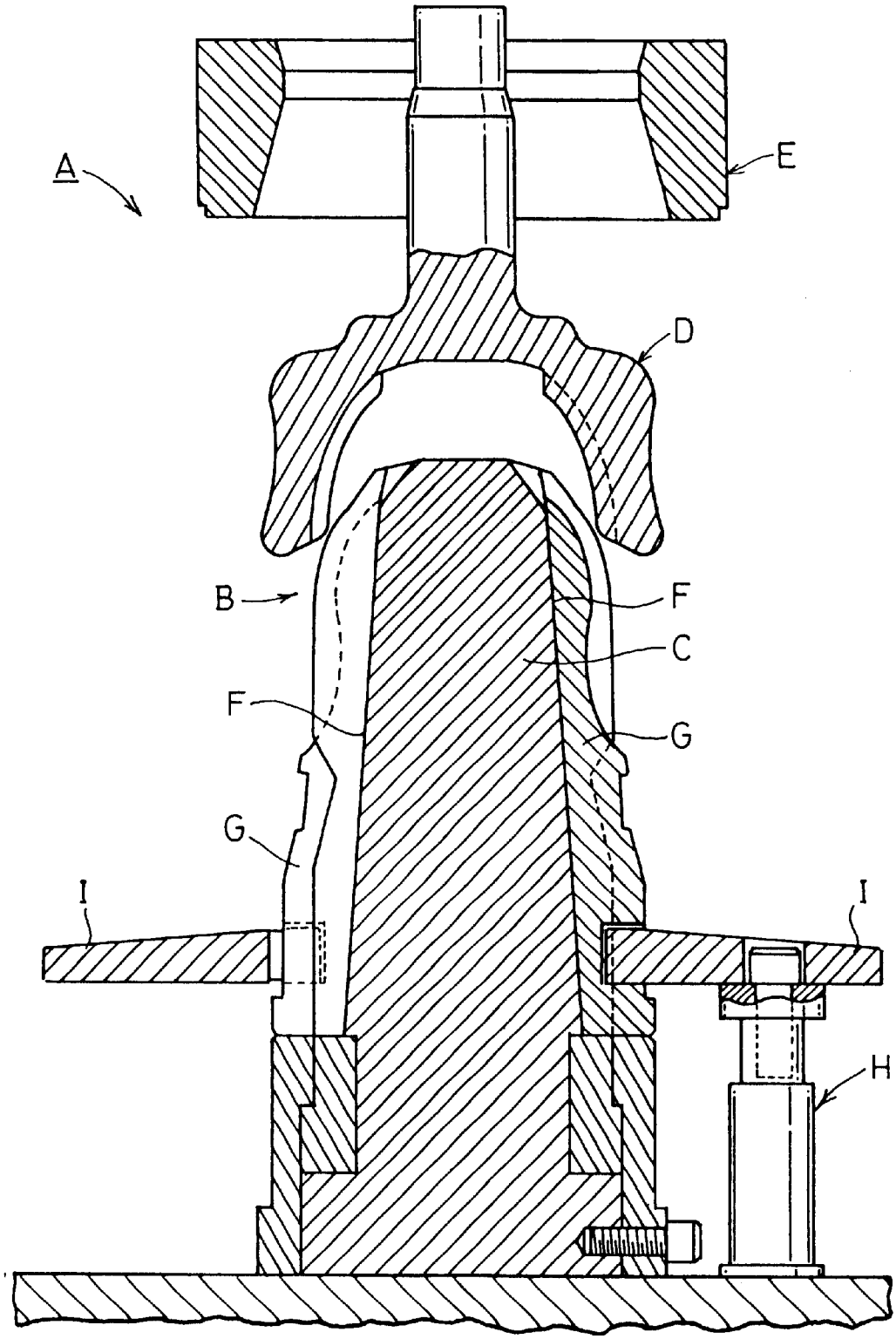
FIG. 13 illustrates a state before a workpiece is machined with a conventional forming machine.
Figure 14:
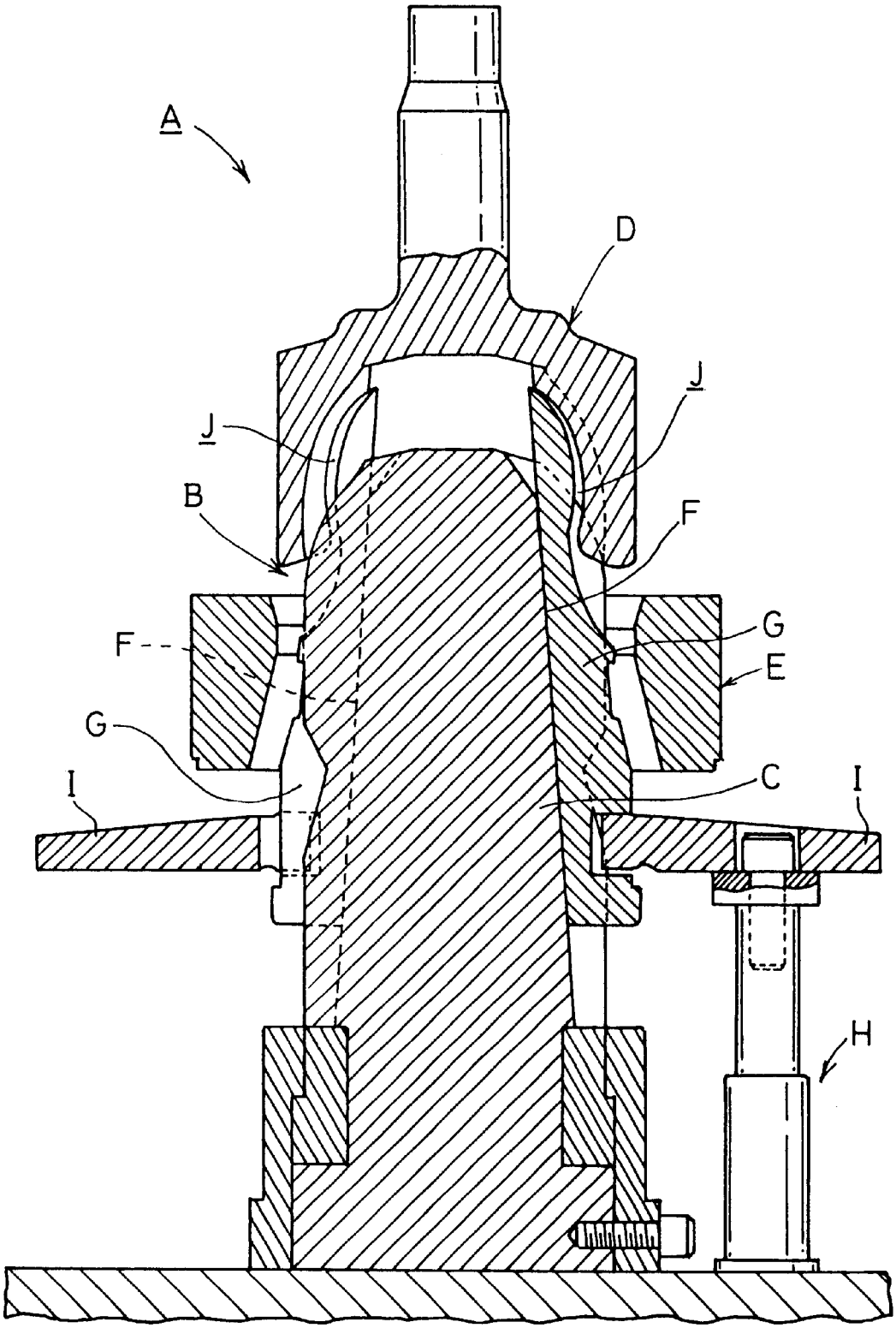
FIG. 14 illustrates a state immediately before the workpiece is disengaged from the forming machine concerning the forming machine shown in FIG. 13.
Figure 15:
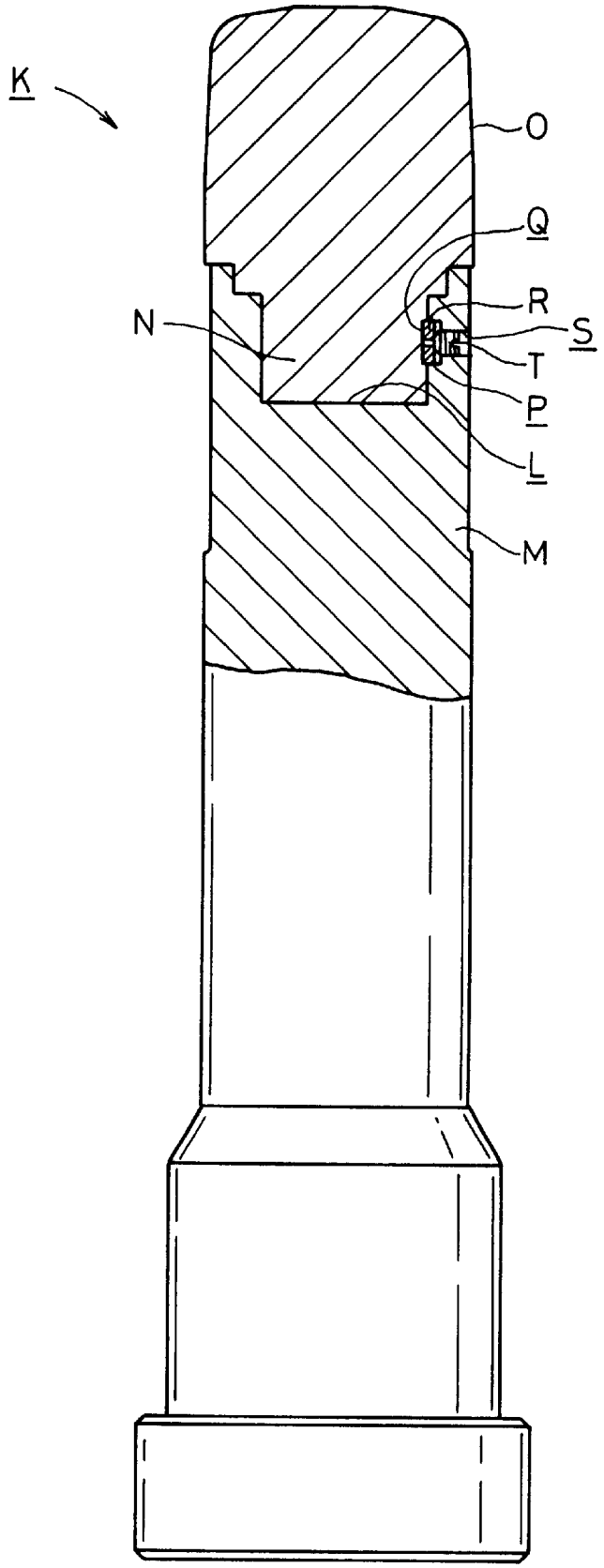
FIG. 15 shows, with partial cutaway, a front view illustrating a forming punch concerning another conventional technique.

In accordance with the sliding movement of the punch collets 120*a* to 120*f* on the sliding contact surfaces 148*a* to 148*f*, the rods 174*a* to 174*f*, which penetrate through the inside of the holes 136*a* to 136*f* formed through the punch base 126, are moved upwardly in the holes 136*a* to 136*f*. Accordingly, the coil springs 176*a* to 176*f*, which are seated on the upper surfaces of the large diameter sections 139*a* to 139*f* of the holes 136*a* to 136*f* and the flanges 175*a* to 175*f* of the rods 174*a* to 174*f*, are contracted to increase the resilient force (see FIG. 12).

The sliding contact surfaces 148*a* to 148*f* are formed so that they are inclined by the predetermined angle in the direction to make approach to the axis of the mandrel 128. Therefore, as the punch collets 120*a* to 120*f* slide upwardly on the sliding contact surfaces 148*a* to 148*f*, the distances between the forward ends of the mutually opposing punch collets 120*a* to 120*f* are narrowed as a whole. As a result, when the workpiece W is displaced by a predetermined distance, a gap 194 is formed between the workpiece W and the punch collets 120*a* to 120*f* (see FIG. 12). The workpiece W can be disengaged from the punch collets 120*a* to 120*f* with ease by utilizing the gap 194.

The disengaged workpiece W is transported to the next step by the aid of the transport mechanism (not shown), to which a predetermined aftertreatment is applied.

Simultaneously with the disengagement of the workpiece W from the punch collets 120*a* to 120*f*, the punch collets 120*a* to 120*f* make sliding movement in the downward direction along the sliding contact surfaces 148*a* to 148*f* in accordance with the action of the resilient force of the coil springs 176*a* to 176*f*. The resilient force is applied to the punch collets 120*a* to 120*f* until the punch collets 120*a* to 120*f* are returned to the positions of the state before the workpiece W is fitted to the mandrel 128 for constructing the forming punch 114.

In the embodiment of the present invention, the metal sleeve 122 is externally fitted to the punch base 126, the straight sections 154*a* to 154*f* which are provided for the ridges 152*a* to 152*f* of the mandrel 128, and the legs 158*a* to 158*f* provided for the punch collets 120*a* to 120*f*. Further, the positioning pin 170 is inserted between the inner circumferential surface of the recess 130 formed on the punch base 126 and the outer circumferential surface of the projection 142 formed on the mandrel 128. Accordingly, the punch collets 120*a* to 120*f* are reliably maintained coaxially with the main punch body 118. Further, the surfaces of the straight sections 154*a* to 154*f* and the legs 158*a* to 158*f* are highly accurately polished as described above. Therefore, it is possible to make the contact without providing any gap between the main punch body 118 and the punch collets 120*a* to 120*f* and the metal sleeve 122.

Therefore, it is possible to suppress the occurrence of any axial deviation between the ironing die 16 and the main punch body 118 including the mandrel 128 to which the punch collets 120*a* to 120*f* are fitted as less as possible. Accordingly, when the pressing force is applied to the workpiece W by using the ironing die 16, the pressing force can be applied to the workpiece W substantially uniformly. Therefore, it is possible to highly accurately perform the plastic working for the workpiece W. As a result, it is possible to easily machine the workpiece W in the aftertreatment steps.

As described above, the main punch body 118 is composed of the punch base 126 and the mandrel 128. In this arrangement, the mandrel 128, which is the portion for fitting the workpiece W thereto, is produced with a durable and expensive material so that the mandrel 128 may withstand the plastic working for the workpiece W to be repeatedly performed. However, according to the embodiment of the present invention, it is possible to reduce the production cost for the mandrel 128 by shortening the length of the mandrel 128 as short as possible. Consequently, it is possible to reduce the production cost for the forming machine 100 itself.

Further, the punch base 126 and the mandrel 128 can be easily separated from each other by loosening the bolts 186*a* to 186*f* to remove the forming punch 114 from the base pedestal 112, disengaging the holder 124 and the metal sleeve 122 from the main punch body 118, separating the rods 174*a* to 174*f* from the punch collets 120*a* to 120*f*, and loosening the fastening bolt 172. For example, when the plastic working is performed for a workpiece W having a different shape, the punch collets are exchanged corresponding to the shape of the workpiece W every time when the plastic working is performed. It is necessary to exchange the punch collets 120*a* to 120*f* and the mandrel 128 together therewith in some cases. However, in the embodiment of the present invention, the forming machine 100 is constructed such that the punch collets 120*a* to 120*f* are detachable therefrom. Therefore, it is possible to conveniently exchange the punch collets 120*a* to 120*f*. Accordingly, the versatility of the forming machine 100 is improved, for example, such that it is possible to easily respond to the forming machining for a variety of workpieces.

As explained above, according to the present invention, it is possible to suppress the occurrence of the axial deviation between the ironing die and the forming punch as less as possible, and it is possible to substantially uniformly apply the pressing force to be applied to the workpiece by the ironing die. Therefore, it is possible to improve the accuracy of the plastic working for the workpiece. Further, after the plastic working for the workpiece is completed, the workpiece can be disengaged with ease. Therefore, it is unnecessary to use any complicated mechanism such as a cylinder mechanism for sliding the punch collets. Accordingly, the following specific effect is obtained. That is, the arrangement of the forming machine itself is simplified, and it is possible to realize the small size and the inexpensive price. Further, the forming step itself is quickened, because the resilient force of the coil springs is utilized to restore the punch collets to the original positions. Further, it is possible to produce the forming machine inexpensively, because the structure is simple. Furthermore, the versatility of the forming machine of this type is improved as well, for example, such that it is possible to respond to the machining for a variety of workpieces only by exchanging the punch collets to those which adapt to a shape of a new workpiece.

What is claimed is:

1. A forming machine comprising:

an ironing die for applying pressing force to a workpiece;

a forming punch having sliding contact surfaces formed obliquely with respect to an axis; and a plurality of punch collets capable of sliding on said sliding contact surface, said punch collets having straight sections with surfaces substantially parallel to said axis;

wherein said forming punch further comprises:

a main punch body having said sliding contact surfaces;

a metal sleeve externally fitted to said main punch body and said punch collets, said metal sleeve having an inner surface externally fitted over said straight sections of said punch collets, said punch collects sliding along said inner surface in a direction substantially parallel to said axis;

a holder for holding said metal sleeve; and elastic members accommodated in said holder;

wherein said punch collets are forcibly restored to original positions along said sliding contact surfaces in accordance with resilient force of said elastic members when said ironing die is released from engagement with said workpiece.

2. The forming machine according to claim 1, wherein said elastic member is wound around a guide pin screwed and attached into said holder, and said elastic member is seated on an inner wall of said holder and a holding section of said punch collet.

3. The forming machine according to claim 2, wherein said guide pins, said elastic members, and said sliding contact surfaces are arranged obliquely with respect to an axis of said main punch body.

4. The forming machine according to claim 2, wherein said guide pin and said elastic member are arranged at the same angle of inclination as that of said sliding contact surface disposed closest there to.

5. The forming machine according to claim 3, wherein said guide pin and said elastic member are arranged at the same angle of inclination as that of said sliding contact surface disposed closest thereto.

6. A forming machine comprising:

an ironing die for applying pressing force to a workpiece;

a forming punch having sliding contact surfaces formed obliquely with respect to an axis; and a plurality of punch collets capable of sliding on said sliding contact surfaces, said punch collets having straight sections with surfaces substantially parallel to said axis;

wherein said forming punch further comprises:

a main punch body;

a metal sleeve externally fitted to said main punch body and said punch collets, said metal sleeve having an inner surface externally fitted over said straight sections of said punch collets, said punch collects sliding along said inner surface in a direction parallel to said axis: and a holder for holding said metal sleeve;

wherein said main punch body is composed of a punch base and a mandrel formed separately from said punch base; and said punch collet is slidable on said sliding contact surface formed on said mandrel, said punch collet also comprising an elastic member for pulling said punch collet toward said punch base.

7. The forming machine according to claim 6, wherein said punch base and said mandrel are integrally joined to one another by the aid of a fastening member.

8. The forming machine according to claim 6, wherein:

a rod is attached to each of said plurality of punch collets; and said elastic member is wound around said rod to always pull said punch collet toward said punch base.

9. The forming machine according to claim 7, wherein:

a rod is attached to each of said plurality of punch collets; and said elastic member is wound around said rod to always pull said punch collet toward said punch base.

10. The forming machine according to claim 8, wherein said sliding contact surfaces, said elastic members, and said rods are arranged obliquely at an equal angle with respect to an axis of said main punch body.

* * * * *